US007124549B2

(12) United States Patent
Weber

(10) Patent No.: US 7,124,549 B2
(45) Date of Patent: Oct. 24, 2006

(54) INTERCONNECTABLE PANEL FOR USE PRIMARILY AS FLOORING

(75) Inventor: Jurgen Weber, Ense (DE)

(73) Assignee: Fritz Egger GmbH & Co., Unterradlberg (AT)

( * ) Notice: Subject to any disclaimer, the term of this patent is extended or adjusted under 35 U.S.C. 154(b) by 424 days.

(21) Appl. No.: 10/756,191

(22) Filed: Jan. 12, 2004

(65) Prior Publication Data

US 2004/0187423 A1 Sep. 30, 2004

(30) Foreign Application Priority Data

Jan. 23, 2003 (DE) ..... 103 02 727

(51) Int. Cl.
*E04C 3/00* (2006.01)

(52) U.S. Cl. ..... 52/589.1; 52/578; 52/588.1; 52/592.1

(58) Field of Classification Search ..... 52/588.1, 52/589.1, 590.1, 578, 592.1, 586.2
See application file for complete search history.

(56) References Cited

U.S. PATENT DOCUMENTS

| | | | | |
|---|---|---|---|---|
| 714,987 | A * | 12/1902 | Wolfe | 52/578 |
| 4,426,820 | A | 1/1984 | Terbrack et al. | |
| 6,006,486 | A * | 12/1999 | Moriau et al. | 52/589.1 |
| 6,505,452 | B1 * | 1/2003 | Hannig et al. | 52/582.1 |
| 6,591,568 | B1 * | 7/2003 | Palsson | 52/592.2 |
| 2002/0020127 | A1 * | 2/2002 | Thiers et al. | 52/403.1 |
| 2002/0056245 | A1 * | 5/2002 | Thiers | 52/589.1 |
| 2004/0031226 | A1 * | 2/2004 | Miller et al. | 52/588.1 |
| 2004/0250492 | A1 * | 12/2004 | Becker | 52/578 |

* cited by examiner

*Primary Examiner*—Carl D. Friedman
*Assistant Examiner*—William Gilbert
(74) *Attorney, Agent, or Firm*—Fish & Neave IP Group of Ropes & Gray LLP; Jeffrey H. Ingerman

(57) ABSTRACT

An interconnectable panel has a pair of surfaces on a lateral edge that adjoins a second pair of surfaces on a complementary lateral edge of another panel when the two panels are interconnected. The edge profiles are such that the first pair of adjoined surfaces has a cross-sectional contour in the shape of a segment of a circle. The circle has a center lying in the upper sections of the connected lateral edges. The circle also has a radius measured from the center to the first pair of adjoined surfaces. The second pair of adjoined surfaces is spaced away from the center of the circle by a distance greater than the radius. That distance increases in a direction away from the first pair of adjoined surfaces.

54 Claims, 11 Drawing Sheets

INTERCONNECTABLE PANEL FOR USE PRIMARILY AS FLOORING

BACKGROUND OF THE INVENTION

This invention relates to an interconnectable panel that can be mechanically connected to other interconnectable panels. Such panels are used primarily as a floor covering (e.g., parquet or laminate flooring), but can alternatively be used as wall and ceiling coverings.

Individual panels that can be connected together to form a large, flat surface are known. Many such panels connect together mechanically without adhesives or separate mounting fasteners (e.g., screws or nails). This is advantageous because such panels can be installed more quickly and removed more easily.

These panels may be manufactured from laminate flooring panels made of a wood material. These panels may also be made of wood products in the form of parquet strips or panels or may alternatively be made of a plastic material.

Lateral (i.e., side edge) profile geometries of interconnectable panels having a tongue-and-groove connection for vertically interlocking panels are known. Lateral profile geometries of interconnectable panels having a pair of interlocking surfaces for horizontally interlocking panels are also known. These horizontal interlocking surfaces are usually obliquely aligned with respect to the top and side of the panels and usually engage one another via a "snap-action" or "snap-in" connection as the panels are interconnected.

The terms "snap-action" and "snap-in" connection refer to the manner in which the horizontal interlocking elements of a first panel lateral edge engage the complementary horizontal interlocking surfaces of a second panel lateral edge. Typically, this contact causes at least one element of the connection to bend or deflect during the interlocking process. Such connections, therefore, can only be made by overcoming a mechanical resistance, regardless of, whether the panels are pushed toward one another horizontally or connected via a pivoting motion.

Moreover, if the bent or deflected element remains bent or deflected after the connection is complete, that connection is referred to as "non-positive." This means that the interlocking elements are at least partially bent or deflected in the connected state and consequently exert a reactive/contracting force.

Other panel connections are known to exhibit a "positive" connection. This means that the connecting elements are not bent or deflected after the panels are connected together. However, such connections may still result in the horizontal connection elements/surfaces contacting each other and being bent or deflected during the interconnection process.

A very precise fit between interconnection elements is very important, particularly with respect to the tongue and groove vertical interlock as well as the horizontal connection. However, this fit is typically impaired by forces resulting from the joining of known panels. These forces may, in particular, cause the connecting elements of the horizontal connection to deform, which can result in an inferior fit.

In view of the foregoing, it would be desirable to be able to provide an interconnectable panel in which the fitting accuracy of the vertical interlock and horizontal connection are improved.

SUMMARY OF THE INVENTION

It is an object of the invention to provide an interconnectable panel in which the fitting accuracy of the vertical interlock and horizontal connection are improved.

In accordance with the invention, an interconnectable panel that can be mechanically connected to another panel without adhesives or separate mounting fasteners (e.g., screws or nails) is provided with improved fit. Each panel (which may be, for example, square or rectangular) has a first lateral edge profile and preferably a complementary second lateral edge profile. The two profiles are complementary in that they can engage each another (when on respective panels) to produce a vertical interlock and horizontal connection. The complementary profile geometries are preferably arranged on the panel on opposite lateral edges and may also be arranged on each pair of opposite lateral edges. They may alternatively be arranged in other ways (e.g., complementary profiles may be arranged on adjacent, rather than opposite, lateral edges, or one profile may be arranged on all sides of one panel while the other profile may be arranged on all sides of another panel).

The first lateral edge profile has the following characteristics in accordance with the invention:

- a first contact surface located on the upper end of the first lateral edge,
- a groove,
- an upper lip that upwardly bounds the groove,
- a lower lip that downwardly bounds the groove, the lower lip having a distal end that protrudes beyond the distal end of the upper lip,
- a first fitting surface located on the upper lip,
- a second fitting surface located on the lower lip, and
- a second contact surface located on the lower lip at the distal end.

The first fitting surface and the second fitting surface form part of the vertical interlock on the first lateral edge, while the first contact surface and the second contact surface form part of the horizontal connection on the first lateral edge.

The second lateral edge profile has the following characteristics in accordance with the invention:

- a third contact surface located on the upper end of the second lateral edge,
- a tongue,
- a third fitting surface located on the upper side of the tongue,
- a fourth fitting surface located on the underside of the tongue at the distal end of the tongue, and
- a fourth contact surface located on the underside of the tongue spaced away from the distal end.

The third fitting surface and the fourth fitting surface form part of the vertical interlock on the second lateral edge, while the third contact surface and the fourth contact surface form part of the horizontal connection on the second lateral edge.

When two panels are connected to one another along two complementary lateral edges, the first and third contact surfaces, the second and fourth contact surfaces, the first and third fitting surfaces, and the second and fourth fitting surfaces adjoin one another.

Interconnected first and second lateral edge profiles have the following additional characteristics in accordance with the invention:

- the second and fourth fitting surfaces have a cross-sectional contour in the shape of a segment of a circle, the center of the circle lying in the upper sections of the lateral edges, the circle having a radius measured from the center to the second and fourth fitting surfaces;
- the second and fourth contact surfaces are spaced away from the center by a distance greater than the radius; and
- that distance increases in the direction of the distal end of the lower lip.

To connect two panels each having a respective one of the complementary lateral edges of the invention, a second panel having the second lateral edge is initially positioned at an incline with respect to a first panel, already installed, having the first lateral edge. The second lateral edge of the second panel is aligned along the first lateral edge of the first panel. From this position, the first panel and the second panel adjoin one another in the region of the upper corner of the lateral edges, while the front end of the fourth fitting surface on the tongue simultaneously adjoins the lower lip. The second panel is then pivoted downward relative to the first panel such that the fourth fitting surface slides along the second fitting surface (recall that they form a segment of a circle). The panels adjoin one another in the region of the center of the circle and are pivoted about this center. Consequently, no particular expenditure of force is required during this pivoting movement, and the second and fourth fitting surfaces are not pressed against one another with an excessively high force.

During this pivoting movement, the profile geometries of the invention ensure that the second contact surface and the fourth contact surface are spaced apart from one another. The second contact surface and the fourth contact surface have a contour. The distance from the center of the circle to the second and fourth contact surface contours continuously increases in the direction of the distal end of the lower lip. This ensures that no horizontal connection surfaces adjoin one another until the pivoting movement is substantially completed. The geometry is chosen such that the second contact surface and the fourth contact surface do not come in contact with one another until preferably the pivoting movement is completed (or alternatively, because of manufacturing tolerances, until at least shortly before completion of the pivoting movement).

The profile geometries of the invention distinguish between vertical interlocking and horizontal connection. The tongue-and-groove vertical interlock may not only result in a positive fit, but also a press fit. In other words, a very rigid vertical seat or interlock can be advantageously achieved. The horizontal connection, in contrast, intentionally represents a connection that results in a positive connection; that is, a connection that does not intentionally result in a press fit within the permissible range of manufacturing tolerances.

BRIEF DESCRIPTION OF THE DRAWINGS

The above and other advantages of the invention will be apparent upon consideration of the following detailed description, taken in conjunction with the accompanying drawings, in which like reference characters refer to like parts throughout, and in which.

DETAILED DESCRIPTION OF THE INVENTION

The panel of the invention is preferably used as a flooring panel and can be manufactured from laminate flooring panels made of a wood material. Suitable wood materials include medium density fiber boards (MDF), high density fiber boards (HDF), particle boards, or oriented strand boards (OSB). The panels may also be made of wood products in the form of parquet strips or panels or may alternatively be made of a plastic material. While intended for use primarily as flooring, these panels may also be used in other applications, such as, for example, wall or ceiling coverings.

Figure 1:
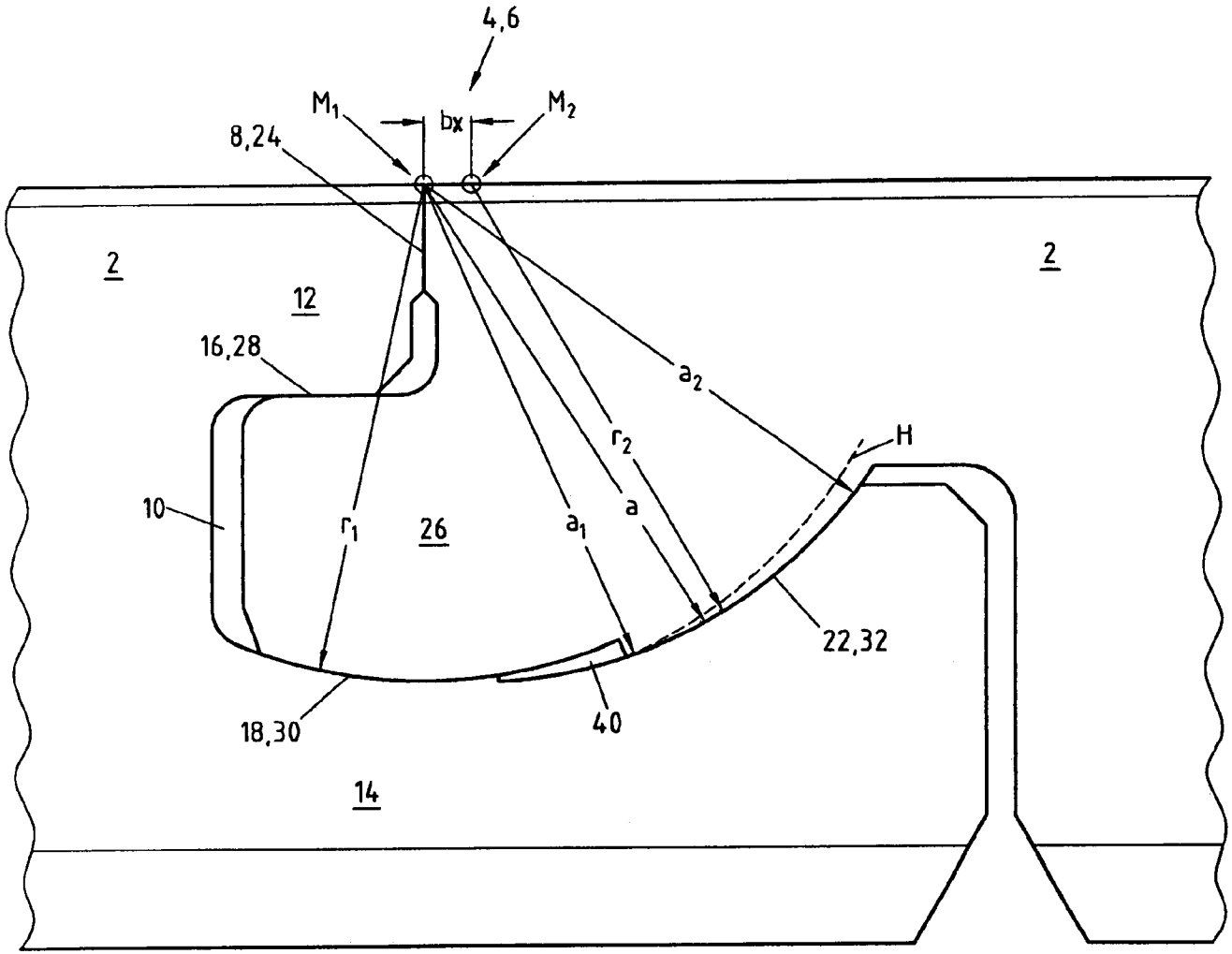
FIGS. 1–3 and 4*a*–*c* are cross-sectional views of a first embodiment of first and/or second interconnectable panel edges according to the invention.
Figure 2:
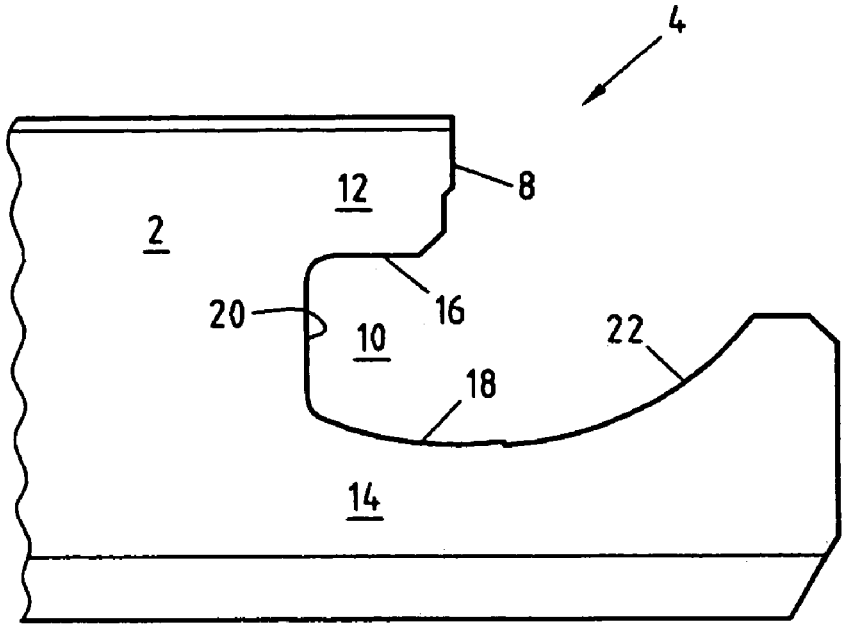
Figure 3:
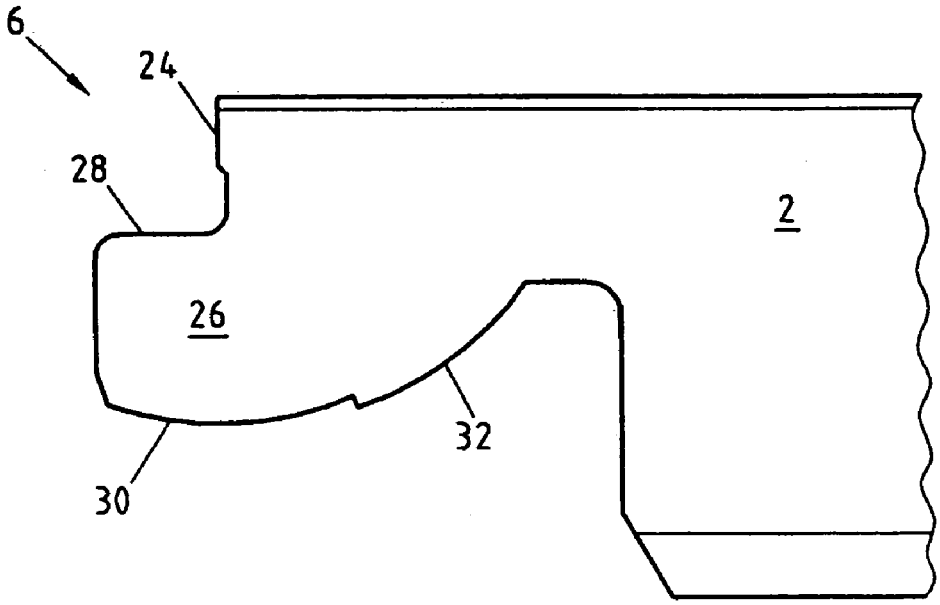
Figure 4A:
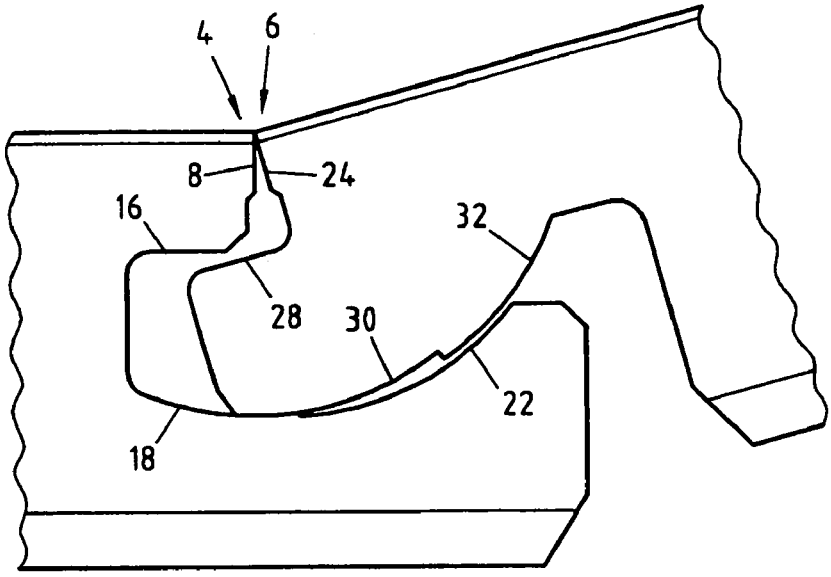
Figure 4B:
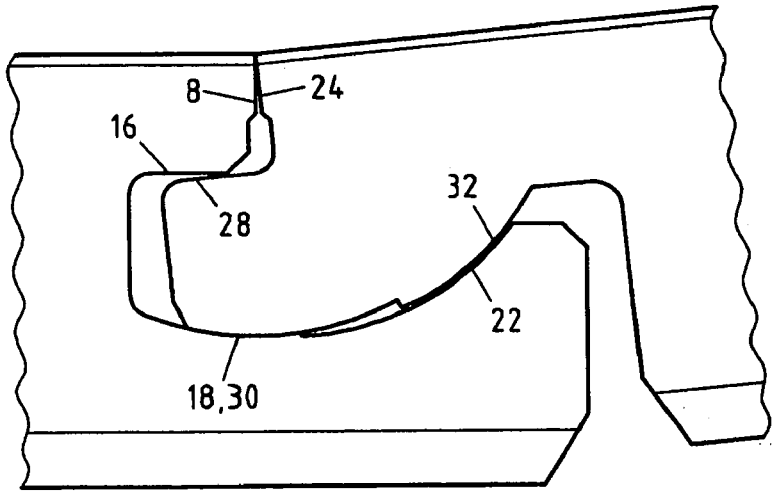
Figure 4C:
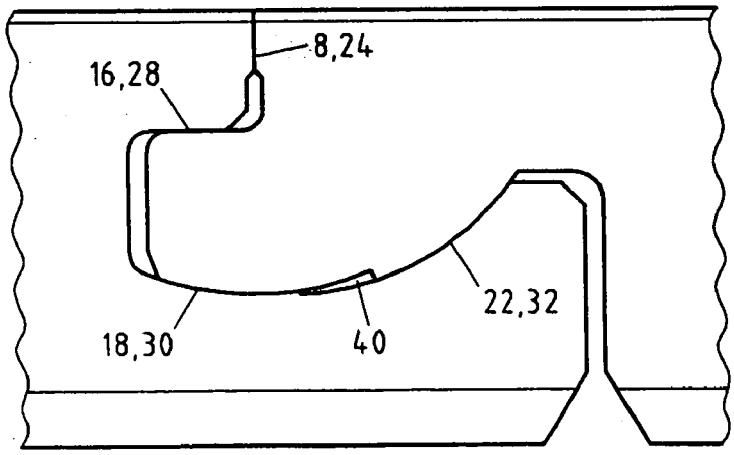

FIGS. 1–3 and 4*a*–*c* show a first embodiment of the invention. FIG. 1 shows the profile geometry of a pair of interconnected panels, FIGS. 2 and 3 separately show the first and second lateral edges, respectively, and FIGS. 4*a*–*c* illustrate the pivoting movement during the joining of two complementary lateral edges.

While the invention pertains primarily to an interconnectable panel preferably having two complementary lateral edges, FIG. 1 shows portions of two panels each having a respective one of the two complementary edges. This is done to illustrate the mechanical connection of the two edges. Accordingly, the scope of the invention also includes an interconnectable panel system in which one panel has at least one of the complementary lateral edges, and one other panel has at least the other complementary lateral edge.

FIG. 2 shows a portion of a panel 2 having a first lateral edge 4. Lateral edge 4 has a first contact surface 8 located on the upper end of lateral edge 4. Lateral edge 4 also has a groove 10, an upper lip 12 that upwardly bounds groove 10, and a lower lip 14 that downwardly bounds groove 10. The distal end of lower lip 14 protrudes beyond the distal end of upper lip 12. A first fitting surface 16 is located on upper lip 12, and a second fitting surface 18 is located on lower lip 14 in the groove bottom region. A second contact surface 22 is located on lower lip 14 in the distal end region.

FIG. 3 shows another portion of panel 2 having a second lateral edge 6 preferably on the opposite side of lateral edge 4. (Alternatively, FIG. 3 shows another panel having lateral edge 6; this panel may or may not be identical to panel 2 and may or may not have a lateral edge 4.) Second lateral edge 6 has a third contact surface 24 located on its upper end. Second lateral edge 6 also has a tongue 26 that has a third fitting surface 28 on the upper side and a fourth fitting surface 30 on the underside. A fourth contact surface 32 is located on the underside of tongue 26 away from the distal end of tongue 26.

The connection of complementary lateral edges 4 and 6 (see FIG. 1) results in the following pairs of adjoined surfaces: first contact surface 8 and third contact surface 24, second contact surface 22 and fourth contact surface 32, first fitting surface 16 and third fitting surface 28, and second fitting surface 18 and fourth fitting surface 30. The connection of complementary lateral edges 4 and 6 also preferably results in a hollow space between tongue 26 and groove backside 20.

Second fitting surface 18 and fourth fitting surface 30 have a cross-sectional contour in the shape of a segment of a circle. The center $M_1$ of the circle lies in the region of the upper sections of lateral edges 4 and 6. The circle has a radius $r_1$ measured from center $M_1$ to second and fourth fitting surfaces 18 and 30. In three-dimensions, second fitting surface 18 and fourth fitting surface 30 have the shape of a cylinder section.

Second contact surface 22 and fourth contact surface 32 are spaced away from center $M_1$ by a distance a, which is greater than radius $r_1$. Distance a (measured from center $M_1$) increases in the direction of the distal end of lower lip 14. This is illustrated with distances $a_1$, a, and $a_2$. Distance a is greater than distance $a_1$, and distance $a_2$ is greater than distance a. In other words, the distance gradually increases outward from center $M_1$ in the direction of the distal end of lower lip 14.

The broken auxiliary curve H in FIG. 1 represents a segment of a circle that begins at the innermost point of contact surfaces 22 and 32 and has a radius equal to distance $a_1$ (which is measured from center $M_1$). The increasing distance between auxiliary curve H and contact surfaces 22 and 32 illustrates the geometry described above.

The pivoting movement during the joining of two complementary lateral edges is now described in greater detail with respect to FIGS. 4*a–c*.

FIG. 4*a* shows a first panel horizontally positioned on a surface (e.g., a floor) and a second panel brought in contact with the right side (first lateral edge 4) of the first panel. Both upper corners of lateral edges 4 and 6 contact one another, and the front region of fitting surface 30 adjoins fitting surface 18. In this position, contact surfaces 22 and 32 are spaced apart from one another as illustrated by the corresponding gap shown in FIG. 4*a*. Similarly, fitting surfaces 16 and 28 and most of contact surfaces 8 and 24 are spaced apart.

FIG. 4*b* shows the second panel in an intermediate pivot position (i.e., the pivoting movement is not yet completed). Fitting surfaces 30 and 18 adjoin one another along a longer section than in FIG. 4*a*, and contact surfaces 22 and 32 are still spaced apart from each other, but by a shorter distance than in FIG. 4*a*. Similarly, fitting surfaces 16 and 28 and most of contact surfaces 8 and 24 are spaced apart by a shorter distance than in FIG. 4*a*.

FIG. 4*c* shows the completion of the pivoting movement, with the described pairs of fitting surfaces and contact surfaces adjoined. A positive fit (or, alternatively, if the dimensions of the elements are chosen accordingly, a press fit) is produced between groove 10 and tongue 26. In addition, a purely positive connection is produced in the region of contact surface pairs 8, 24 and 22, 32 (within the permissible range of manufacturing tolerances). A purely positive connection is one in which none of the elements involved in that connection is deflected or bent during the interconnection process.

The fitting surfaces and contact surfaces, which produce the connection, are consequently not subjected to excessively high forces during the joining process. This means that two panels can engage one another along the lateral edges without damaging the interlocking and connecting elements, thus providing an improved fit.

Returning to FIG. 1, center $M_1$ coincides with the upper corner of lateral edges 4 and 6. This ensures that fitting surfaces 18 and 30 are able to slide on one another without becoming wedged during the pivoting movement. In other words, fitting surfaces 18 and 30 do not impair the pivoting movement.

As shown in FIGS. 1–4, second contact surface 22 and fourth contact surface 32 also have a curved cross-sectional contour. This contour preferably extends in the steepest fashion possible in the region of the distal end of the lower lip 14 in order to ensure that an adequate connection in the horizontal direction is produced. Preferably, at least sections of second contact surface 22 and fourth contact surface 32 have a cross-sectional contour in the shape of a segment of a circle. The center $M_2$ of this circle is spaced apart from center $M_1$ by a distance bx (see FIG. 1). In this embodiment, radius $r_2$ is greater than or equal to radius $r_1$. This ensures that the distance from $M_1$ to contact surfaces 22 and 32 gradually increases in the direction of the distal end of lower lip 14 (i.e., toward the right in the FIGS.). However, under certain circumstances, radius $r_2$ may be less than radius $r_1$. This results in steeper contact surfaces 22 and 32 in the region of the distal end of the lower lip 14.

FIGS. 5–14*c* show other embodiments of the invention. Identical reference symbols identify the same characteristics/features as those described above with respect to the first embodiment. Characteristics that differ from the first embodiment are identified by apostrophes and are described below.

Figure 5:
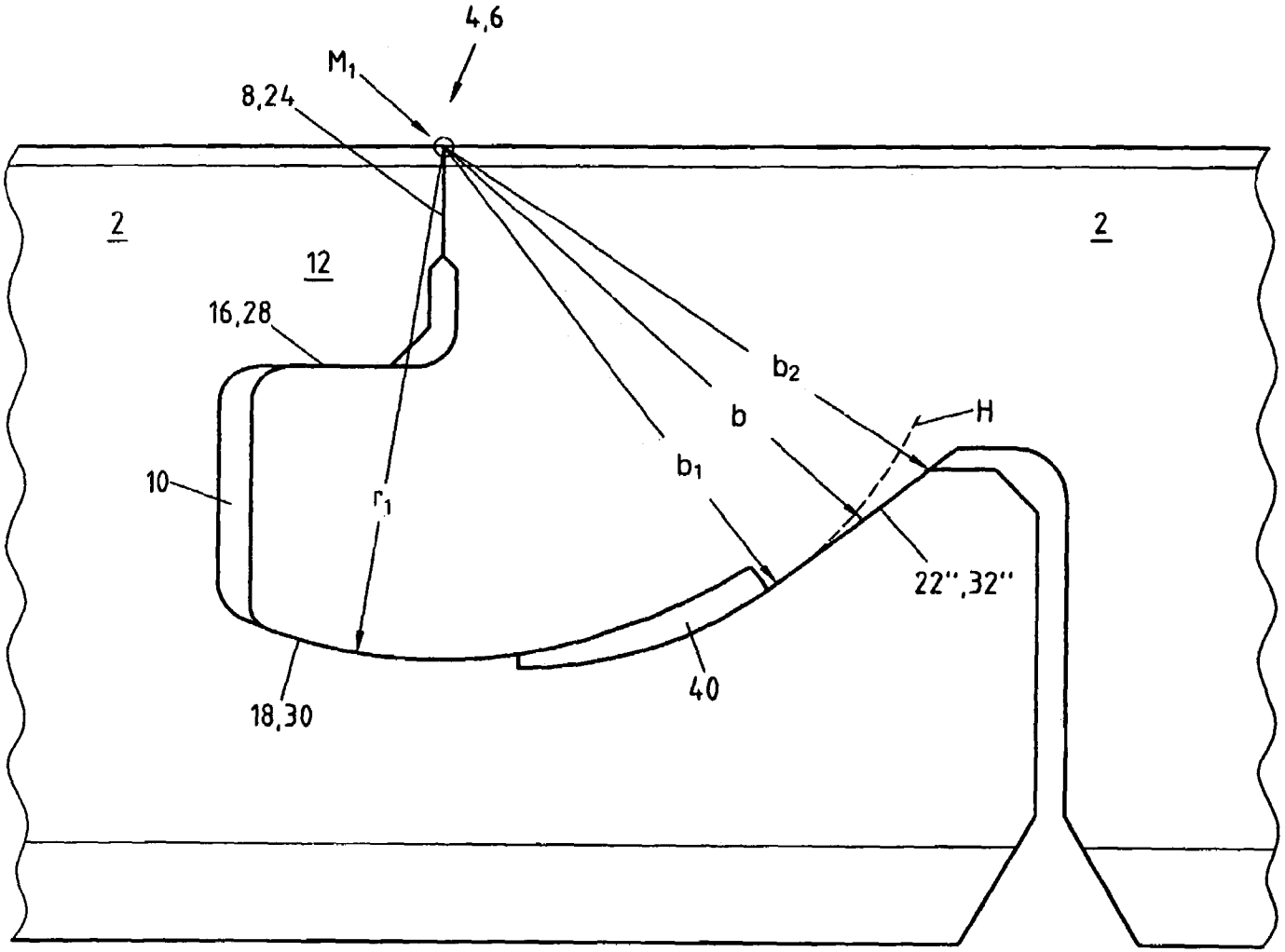
FIGS. 5–7 and 8*a*–*c* are cross-sectional views of a second embodiment of first and/or second interconnectable panel edges according to the invention.
Figure 6:
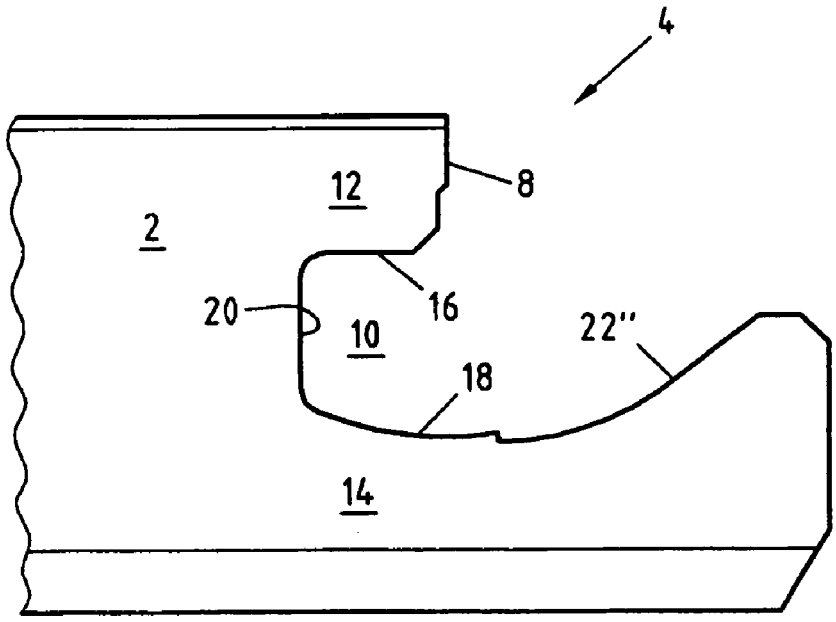
Figure 7:
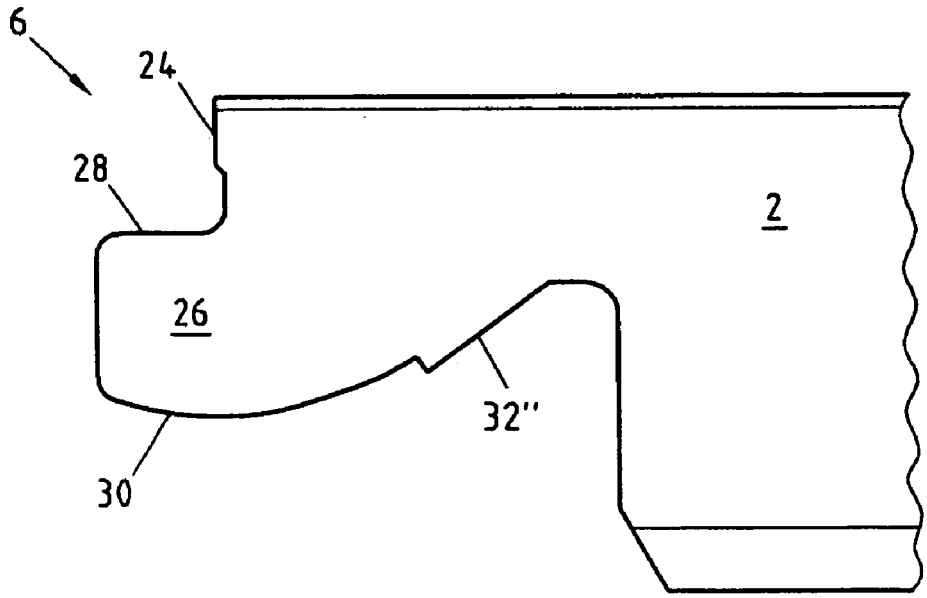

FIGS. 5–8*c* show a second embodiment of interconnectable panel 2 (or, alternatively, two different panels) in accordance with the invention. In contrast to the first embodiment, second contact surface 22" and fourth contact surface 32" have a straight cross-sectional contour that extends obliquely upward in the direction of the distal end of lower lip 14. However, despite this modification, the distance between contact surfaces 22" and 32" and center $M_1$ also increases outwardly in the direction of the distal end of lower lip 14. This is illustrated in FIG. 5 by distances $b_1$, b, and $b_2$ and auxiliary curve H.

Figure 8A:
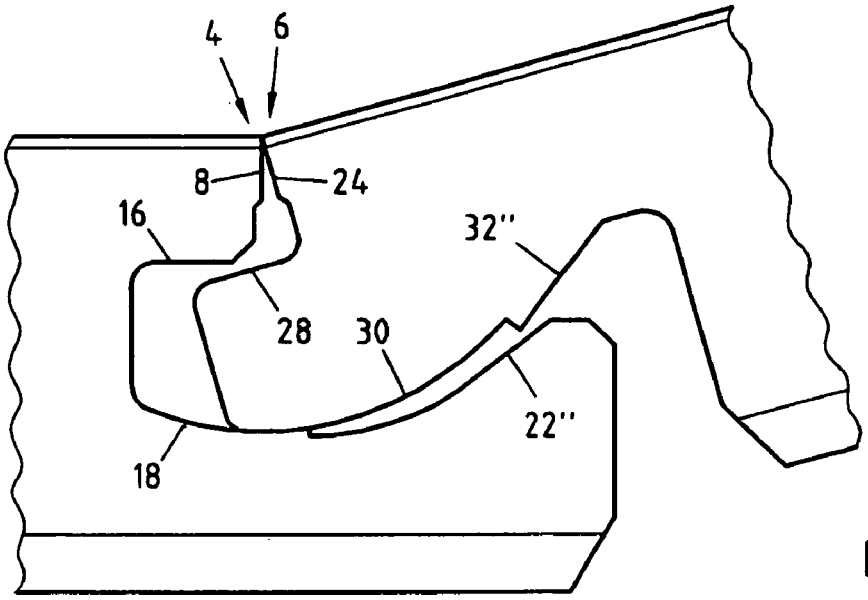
Figure 8B:
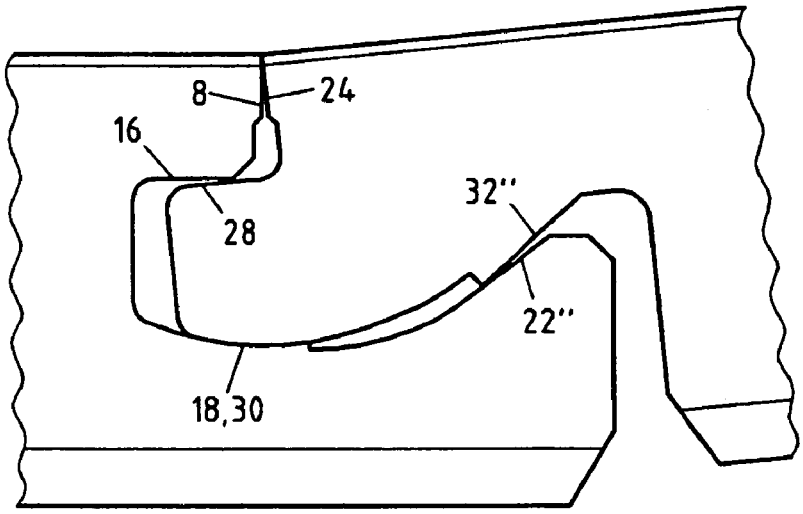
Figure 8C:
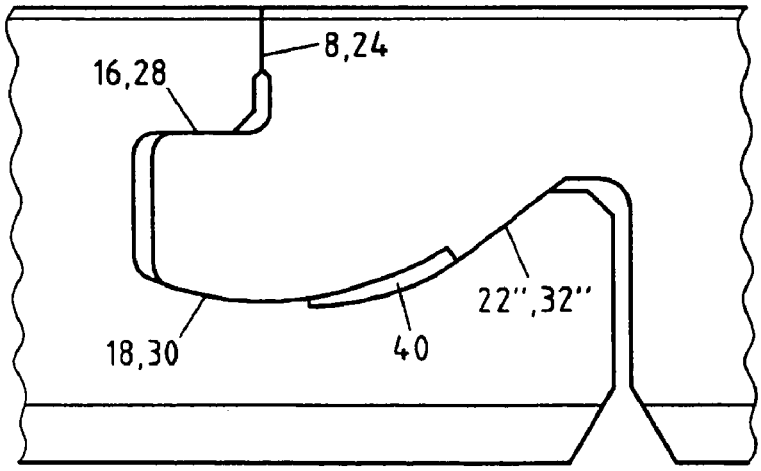
Figure 9:
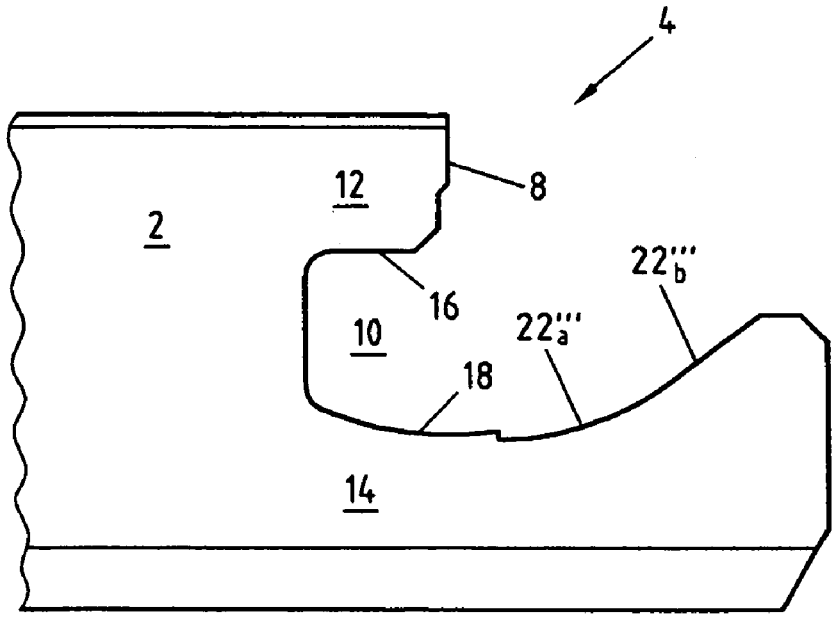
FIGS. 9, 10, and 11*a*–*c* are cross-sectional views of a third embodiment of first and/or second interconnectable panel edges according to the invention.
Figure 10:
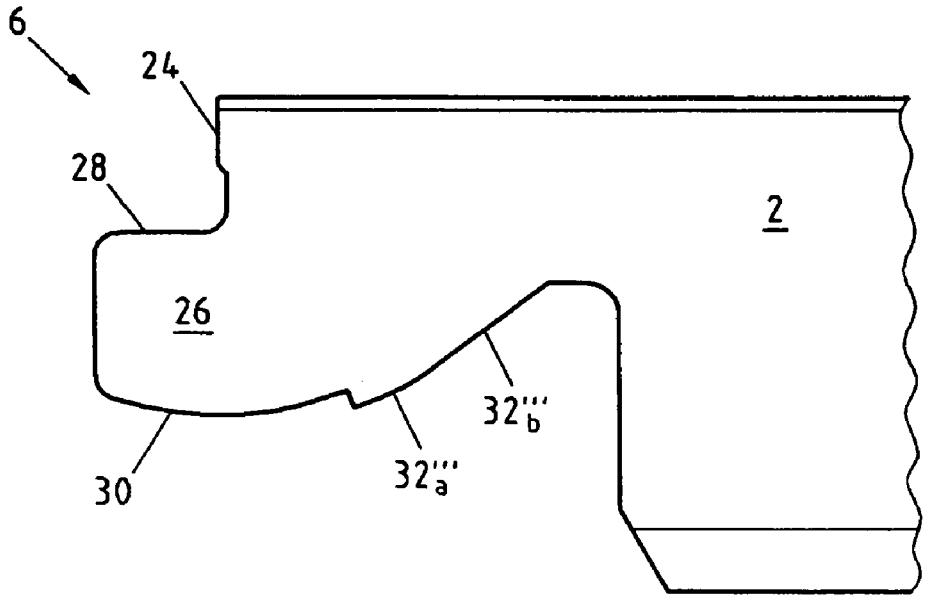
Figure 11A:
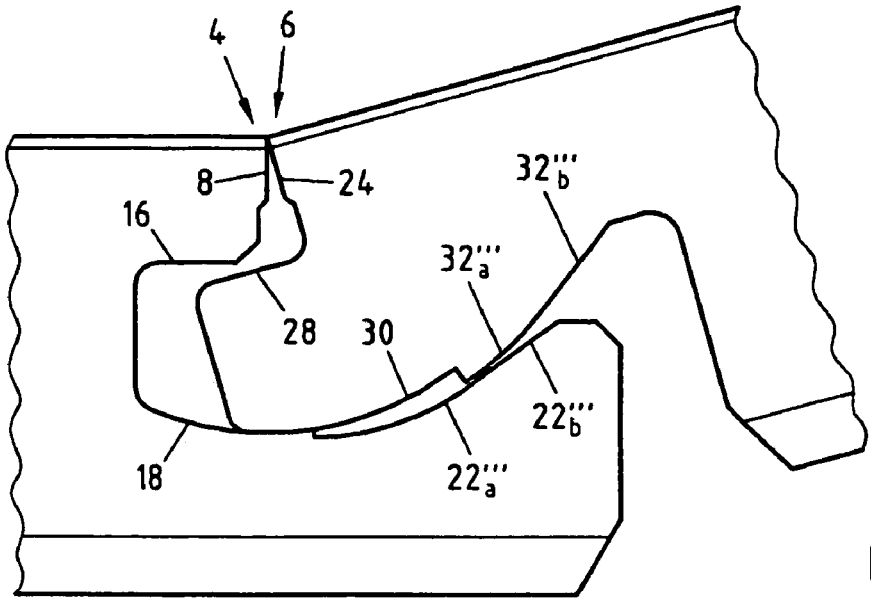
Figure 11B:
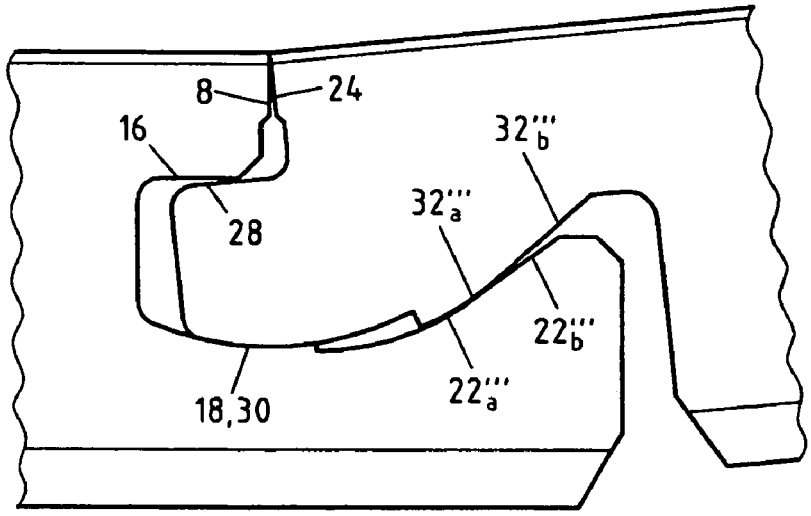
Figure 11C:
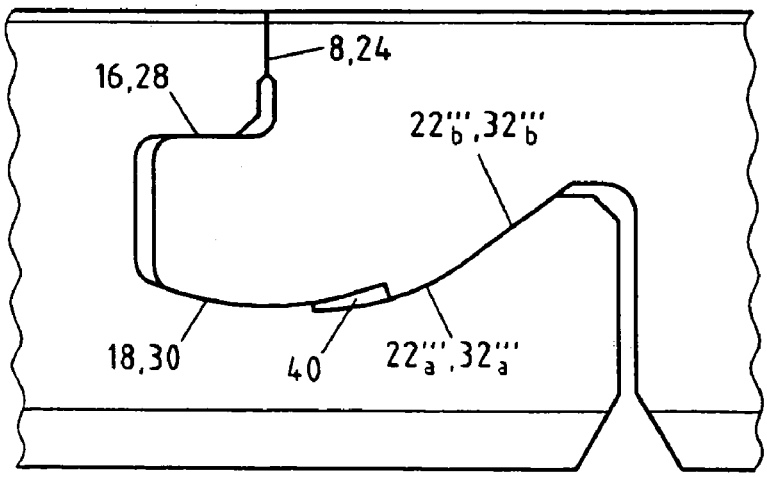

The pivoting movement illustrated in FIGS. 8*a–c* is substantially identical to that of the first embodiment. Contact surfaces 22" and 32", in particular, do not come in substantial contact with one another until the pivoting movement is completed.

In other respects, the previous description of the first embodiment shown in FIGS. 1–4*c* applies analogously to the embodiment shown in FIGS. 5–8*c*.

FIGS. 9–11*c* show another embodiment of the invention that includes a combination of some of the characteristics of the first two embodiments. In this third embodiment, contact surfaces 22'" and 32'" respectively include (1) curved sections 22*a'"* and 32*a'"*, which preferably have the shape of a segment of a circle, and (2) straight sections 22*b'"* and 32*b'"*.

Figure 12A:
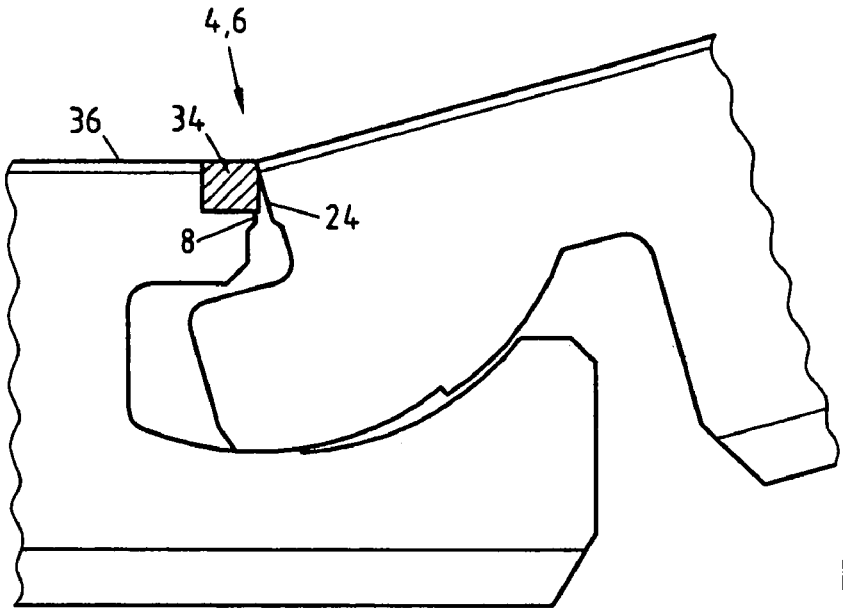
FIGS. 12*a*–*c* are cross-sectional views of a fourth embodiment of first and second interconnectable panel edges according to the invention.
Figure 12B:
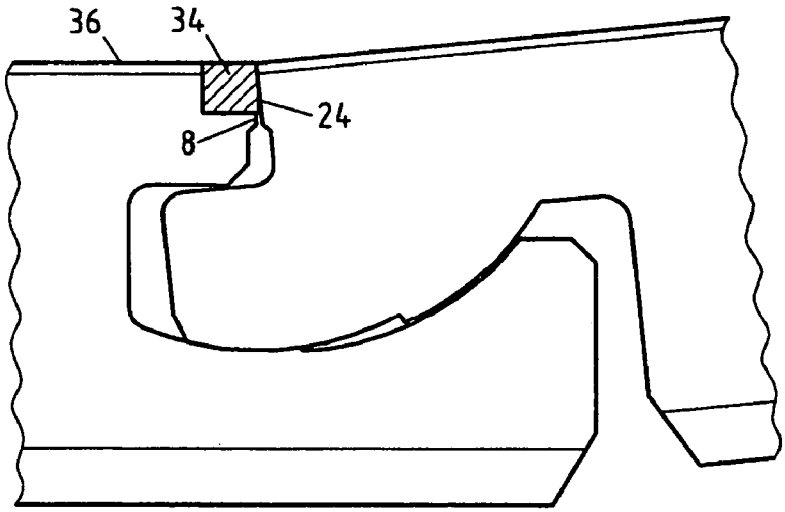
Figure 12C:
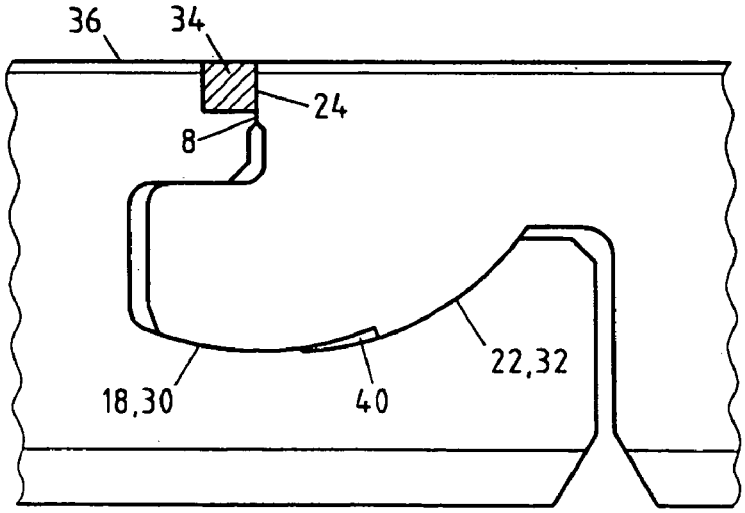

The embodiment shown in FIGS. 12*a–c* has fitting surfaces and contact surfaces that are identical to those of the first embodiment. A profiled strip 34 is additionally provided in the region of first contact surface 8. This profiled strip is made of an elastic material, which is preferably a plastic material such as PVC. Profiled strip 34 ends flush with upper side 36 of panel 2 and protrudes slightly beyond first contact surface 8. During the pivoting movement, shown in FIGS. 12*a–c*, profiled strip 34 is compressed (to left in the FIGS.) because of the increasing contact pressure generated by contact surface 24. This results in a sealed connection between lateral edges 4 and 6. Moreover, the elasticity of compressed profiled strip 34 results in a force that presses against contact surfaces 22 and 32. Profiled strip 34 is externally visible and can be used to achieve certain optical effects. Profiled strip 34 may also be arranged in the region of third contact surface 24 and similarly compressed by contact surface 8 during the pivoting movement.

Figure 13A:
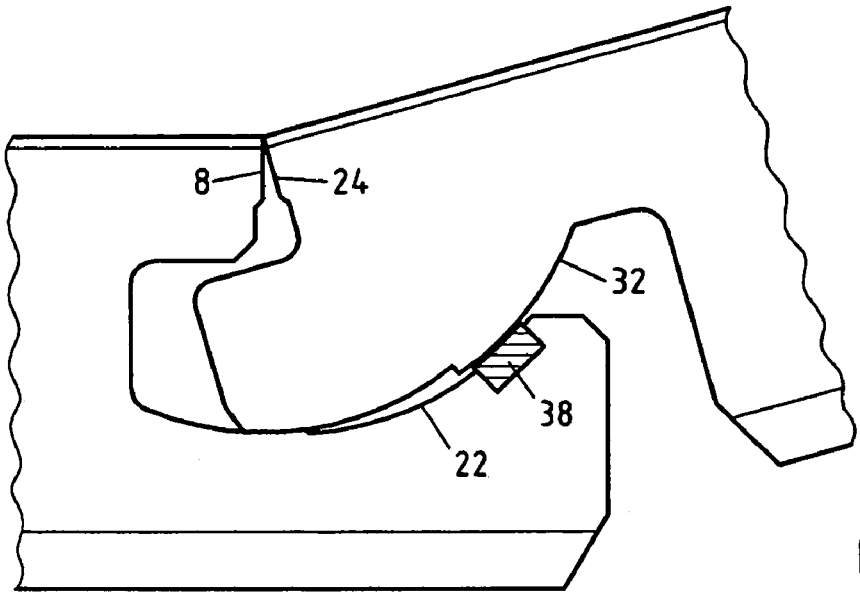
FIGS. 13*a*–*c* are cross-sectional views of a fifth embodiment of first and second interconnectable panel edges according to the invention.
Figure 13B:
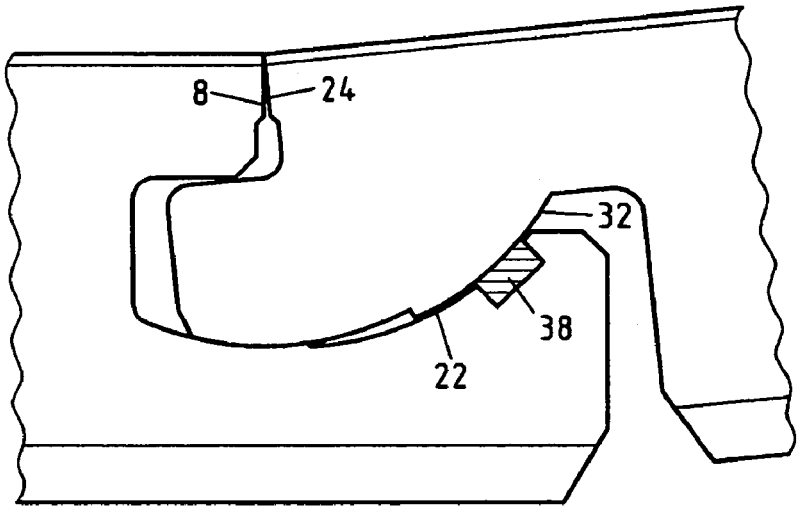
Figure 13C:
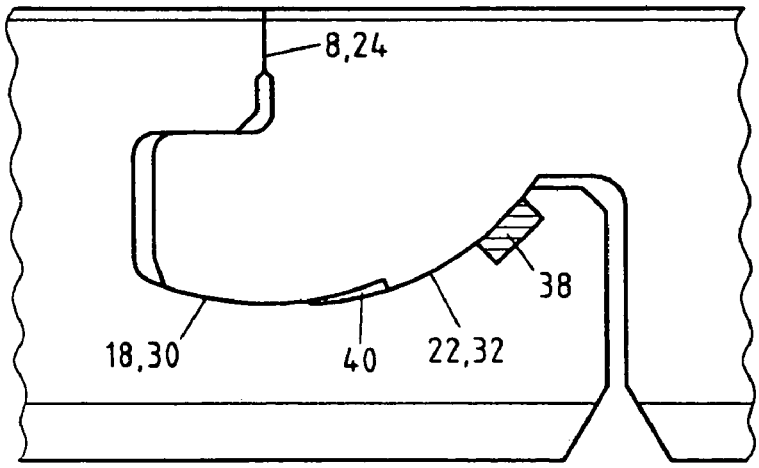

FIGS. 13*a–c* show another embodiment of first and second lateral edges of one or more interconnectable panels in accordance with the invention. The fitting surfaces and contact surfaces of this embodiment are again identical to those of the first embodiment. An elastic element 38 is additionally provided in the region of second contact surface 22. Elastic element 38 is made of an elastic material, which is preferably a plastic material such as PVC. Elastic element 38 is recessed into and protrudes slightly beyond contact surface 22. During the pivoting movement, shown in FIGS. 13*a–c*, elastic element 38 is compressed in the direction of contact surface 22 because of the increasing contact pressure generated by contact surface 32. The elasticity of element 38 generates a force that presses against contact surfaces 8 and 24. Elastic element 38 may also be arranged in the region of fourth contact surface 32 and accordingly compressed during the pivoting movement because of the increasing contact pressure generated by contact surface 22.

Note that profiled strip 34 and elastic element 38 may be included in other embodiments of the invention.

FIGS. 1, 4*c*, 5, 8*c*, 11*c*, 12*c*, and 13*c* show a hollow space 40 formed between adjoined second and fourth fitting surfaces 18 and 30 and adjoined second and fourth contact surfaces 22 and 32. This space is optional. In an alternative embodiment, fitting surface 18 and contact surface 22, and fitting surface 30 and contact surface 32, transform seamlessly into one another, respectively.

Figure 14A:
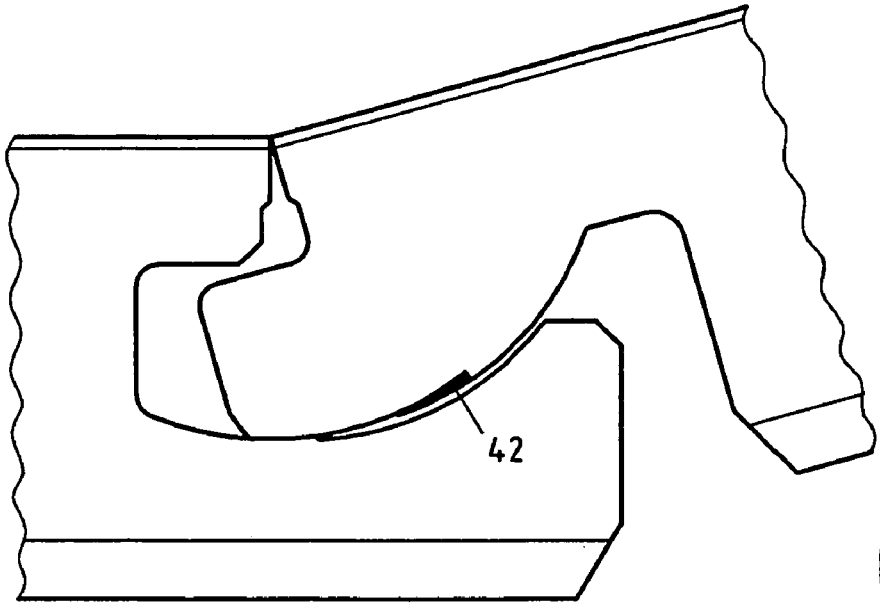
FIGS. 14*a*–*c* are cross-sectional views of a sixth embodiment of first and second interconnectable panel edges according to the invention.
Figure 14B:
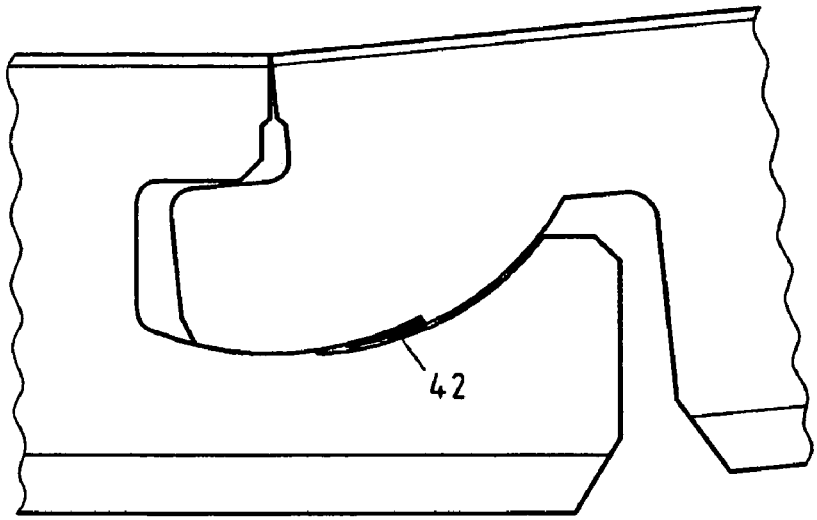
Figure 14C:
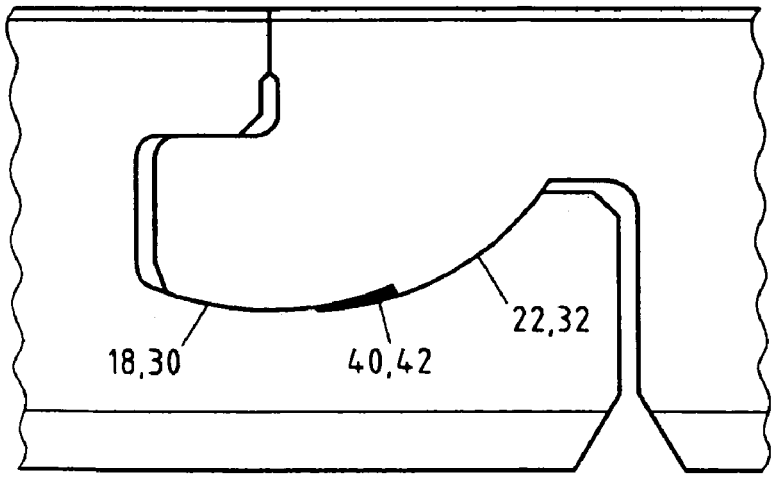

Although panels of the invention can be mechanically connected to other panels without adhesives or separate mounting fasteners (e.g., screws or nails), an optional glue layer 42 may be applied within hollow space 40, as shown in FIGS. 14*a–c*, to produce an adhesive connection when complementary lateral edges 4 and 6 are joined. Thus, in addition to the interlocking and connecting elements, such a glue layer counteracts a separation of the lateral edges. Glue layer 42 is preferably applied to one lateral edge at the manufacturing site, and is preferably any conventional adhesive suitable for later application (i.e., does not require immediate joining of parts).

Thus it is seen that interconnectable panels with improved fit are provided. One skilled in the art will appreciate that the invention can be practiced by other than the described embodiments, which are presented for purposes of illustration and not of limitation, and the invention is limited only by the claims which follow.

I claim:

1. A panel mechanically connectable to another panel, said panel comprising:

a first lateral edge having:

a first contact surface located on an upper end of the first lateral edge, a groove, an upper lip that upwardly bounds the groove, a lower lip that downwardly bounds the groove, the distal end of the lower lip protruding beyond the distal end of the upper lip, a first fitting surface located on the upper lip, a second fitting surface located on the lower lip away from the distal end of the lower lip, and a second contact surface located on the lower lip at the distal end of the lower lip; and a second lateral edge having:

a third contact surface located on an upper end of the second lateral edge, a tongue extending from the second lateral edge, a third fitting surface located on the top of the tongue, a fourth fitting surface located on the underside of the tongue at the distal end of the tongue, and a fourth contact surface located on the underside of the tongue away from the distal end of the tongue; wherein:

the first and second lateral edges are connectable to each other when on respective panels such that when connected:

the first contact surface and third contact surface, the second contact surface and the fourth contact surface, the first fitting surface and the third fitting surface, and the second fitting surface and the fourth fitting surface respectively adjoin one another;

the second fitting surface and the fourth fitting surface have a cross-sectional contour in the shape of a segment of a circle, the circle having a center lying in a region of the upper sections of the first and second lateral edges, the circle having a radius measured from the center to the second and fourth fitting surfaces;

the second contact surface and the fourth contact surface are spaced away from the center by a distance larger than the radius; and the distance increases in the direction of the distal end of the lower lip.

2. The panel of claim 1 wherein the center coincides with the upper corner of the first and second lateral edges.

3. The panel of claim 2 wherein at least a section of the second contact surface and the fourth contact surface has a curved contour.

4. The panel of claim 2 wherein at least a section of the second contact surface and the fourth contact surface has a straight cross-sectional contour.

5. The panel of claim 2 wherein the second contact surface and the fourth contact surface have a straight cross-sectional contour that extends obliquely upward in the direction of the distal end of the lower lip.

6. The panel of claim 2 further comprising a profiled strip fixed to the first contact surface or the third contact surface.

7. The panel of claim 2 further comprising an elastic element imbedded in the second contact surface or in the fourth contact surface, the elastic element protruding slightly beyond the second or fourth contact surface, respectively.

8. The panel of claim 2 wherein a hollow space is formed between adjoined second and fourth fitting surfaces and adjoined second and fourth contact surfaces.

9. The panel of claim 1 wherein at least a section of the second contact surface and the fourth contact surface has a curved contour.

10. The panel of claim 9 wherein at least a section of the second contact surface and the fourth contact surface has a straight cross-sectional contour.

11. The panel of claim 9 further comprising a profiled strip fixed to the first contact surface or the third contact surface.

12. The panel of claim 9 further comprising an elastic element imbedded in the second contact surface or in the fourth contact surface, the elastic element protruding slightly beyond the second or fourth contact surface, respectively.

13. The panel of claim 9 wherein a hollow space is formed between adjoined second and fourth fitting surfaces and adjoined second and fourth contact surfaces.

14. The panel of claim 9 wherein at least a section of the second contact surface and the fourth contact surface have a contour in the shape of a segment of a circle.

15. The panel of claim 14 wherein the contour of the second contact surface and the fourth contact surface has a radius greater than or equal to the radius of the contour of the second and fourth fitting surfaces.

16. The panel of claim 14 wherein the contour of the second contact surface and the fourth contact surface has a radius less than the radius of the contour of the second and fourth fitting surfaces.

17. The panel of claim 14 wherein at least a section of the second contact surface and the fourth contact surface has a straight cross-sectional contour.

18. The panel of claim 14 further comprising a profiled strip fixed to the first contact surface or the third contact surface.

19. The panel of claim 14 further comprising an elastic element imbedded in the second contact surface or in the fourth contact surface, the elastic element protruding slightly beyond the second or fourth contact surface, respectively.

20. The panel of claim 14 wherein a hollow space is formed between adjoined second and fourth fitting surfaces and adjoined second and fourth contact surfaces.

21. The panel of claim 14 wherein the circle contour of the second and fourth contact surfaces has a center spaced apart from the center of the circle contour of the second and fourth fitting surfaces.

22. The panel of claim 21 wherein at least a section of the second contact surface and the fourth contact surface has a straight cross-sectional contour.

23. The panel of claim 21 further comprising a profiled strip fixed to the first contact surface or the third contact surface.

24. The panel of claim 21 further comprising an elastic element imbedded in the second contact surface or in the fourth contact surface, the elastic element protruding slightly beyond the second or fourth contact surface, respectively.

25. The panel of claim 21 wherein a hollow space is formed between adjoined second and fourth fitting surfaces and adjoined second and fourth contact surfaces.

26. The panel of claim 21 wherein the contour of the second contact surface and the fourth contact surface has a radius greater than or equal to the radius of the contour of the second and fourth fitting surfaces.

27. The panel of claim 26 wherein at least a section of the second contact surface and the fourth contact surface has a straight cross-sectional contour.

28. The panel of claim 26 further comprising a profiled strip fixed to the first contact surface or the third contact surface.

29. The panel of claim 26 further comprising an elastic element imbedded in the second contact surface or in the fourth contact surface, the elastic element protruding slightly beyond the second or fourth contact surface, respectively.

30. The panel of claim 26 wherein a hollow space is formed between adjoined second and fourth fitting surfaces and adjoined second and fourth contact surfaces.

31. The panel of claim 21 wherein the contour of the second contact surface and the fourth contact surface has a radius less than the radius of the contour of the second and fourth fitting surfaces.

32. The panel of claim 31 wherein at least a section of the second contact surface and the fourth contact surface has a straight cross-sectional contour.

33. The panel of claim 31 further comprising a profiled strip fixed to the first contact surface or the third contact surface.

34. The panel of claim 31 further comprising an elastic element imbedded in the second contact surface or in the fourth contact surface, the elastic element protruding slightly beyond the second or fourth contact surface, respectively.

35. The panel of claim 31 wherein a hollow space is formed between adjoined second and fourth fitting surfaces and adjoined second and fourth contact surfaces.

36. The panel of claim 1 wherein at least a section of the second contact surface and the fourth contact surface has a straight cross-sectional contour.

37. The panel of claim 36 further comprising a profiled strip fixed to the first contact surface or the third contact surface.

38. The panel of claim 36 further comprising an elastic element imbedded in the second contact surface or in the fourth contact surface, the elastic element protruding slightly beyond the second or fourth contact surface, respectively.

39. The panel of claim 36 wherein a hollow space is formed between adjoined second and fourth fitting surfaces and adjoined second and fourth contact surfaces.

40. The panel of claim 1 wherein the second contact surface and the fourth contact surface have a straight cross-sectional contour that extends obliquely upward in the direction of the distal end of the lower lip.

41. The panel of claim 40 further comprising a profiled strip fixed to the first contact surface or the third contact surface.

42. The panel of claim 40 further comprising an elastic element imbedded in the second contact surface or in the fourth contact surface, the elastic element protruding slightly beyond the second or fourth contact surface, respectively.

43. The panel of claim 40 wherein a hollow space is formed between adjoined second and fourth fitting surfaces and adjoined second and fourth contact surfaces.

44. The panel of claim 1 further comprising a profiled strip fixed to the first contact surface or the third contact surface.

45. The panel of claim 44 further comprising an elastic element imbedded in the second contact surface or in the fourth contact surface, the elastic element protruding slightly beyond the second or fourth contact surface, respectively.

46. The panel of claim 44 wherein a hollow space is formed between adjoined second and fourth fitting surfaces and adjoined second and fourth contact surfaces.

47. The panel of claim 44 wherein the profiled strip ends flush with a top side of the panel and protrudes slightly beyond the first contact surface or the third contact surface.

48. The panel of claim 47 further comprising an elastic element imbedded in the second contact surface or in the fourth contact surface, the elastic element protruding slightly beyond the second or fourth contact surface, respectively.

49. The panel of claim 11 wherein a hollow space is formed between adjoined second and fourth fitting surfaces and adjoined second and fourth contact surfaces.

50. The panel of claim 1 further comprising an elastic element imbedded in the second contact surface or in the fourth contact surface, the elastic element protruding slightly beyond the second or fourth contact surface, respectively.

51. The panel of claim 50 wherein a hollow space is formed between adjoined second and fourth fitting surfaces and adjoined second and fourth contact surfaces.

52. The panel of claim 1 wherein a hollow space is formed between adjoined second and fourth fitting surfaces and adjoined second and fourth contact surfaces.

53. The panel of claim 52 further comprising a glue layer applied within the hollow space.

54. An interconnectable panel system comprising:

a first panel having a lateral edge, said lateral edge having:

a first contact surface located on an upper end of the lateral edge, a groove, an upper lip that upwardly bounds the groove, a lower lip that downwardly bounds the groove, the distal end of the lower lip protruding beyond the distal end of the upper lip, a first fitting surface located on the upper lip, a second fitting surface located on the lower lip away from the distal end of the lower lip, and a second contact surface located on the lower lip at the distal end of the lower lip; and a second panel having a lateral edge, the second panel lateral edge having:

a third contact surface located on an upper end of the second panel lateral edge, a tongue extending from the second panel lateral edge, a third fitting surface located on the top of the tongue, a fourth fitting surface located on the underside of the tongue at the distal end of the tongue, and a fourth contact surface located on the underside of the tongue away from the distal end of the tongue; wherein:

the first and second panels are interconnectable along their respective lateral edges such that when connected:

the first contact surface and third contact surface, the second contact surface and the fourth contact surface, the first fitting surface and the third fitting surface, and the second fitting surface and the fourth fitting surface respectively adjoin one another;

the second fitting surface and the fourth fitting surface have a cross-sectional contour in the shape of a segment of a circle, the circle having a center lying in the region of the upper sections of the first and second panel lateral edges, the circle having a radius measured from the center to the second and fourth fitting surfaces;

the second contact surface and the fourth contact surface are spaced away from the center by a distance measured from the center that is larger than the radius; and the distance increases in the direction of the distal end of the lower lip.

* * * * *